US009410780B2

(12) United States Patent
Lunking et al.

(10) Patent No.: US 9,410,780 B2
(45) Date of Patent: Aug. 9, 2016

(54) STRUCTURAL COMPONENT THAT WILL FRAGMENT INTO PARTICLES OF SELECTED GEOMETRY AND REACTIVITY

(71) Applicant: The Johns Hopkins University, Baltimore, MD (US)

(72) Inventors: David Michael Lunking, Columbia, MD (US); Timothy P. Weihs, Baltimore, MD (US)

(73) Assignee: THE JOHNS HOPKINS UNIVERSITY, Baltimore, MD (US)

( * ) Notice: Subject to any disclaimer, the term of this patent is extended or adjusted under 35 U.S.C. 154(b) by 558 days.

(21) Appl. No.: 13/896,661

(22) Filed: May 17, 2013

(65) Prior Publication Data

US 2014/0286818 A1 Sep. 25, 2014

Related U.S. Application Data

(60) Provisional application No. 61/649,515, filed on May 21, 2012, provisional application No. 61/487,772, filed on May 19, 2011.

(51) Int. Cl.

| | |
|---|---|
| ***B22F 3/02*** | (2006.01) |
| ***F42B 12/32*** | (2006.01) |
| ***F42B 12/22*** | (2006.01) |
| *B22F 9/04* | (2006.01) |

(52) U.S. Cl.

CPC ..... *F42B 12/32* (2013.01); *F42B 12/22* (2013.01); *B22F 3/02* (2013.01); *B22F 9/04* (2013.01)

(58) Field of Classification Search

CPC ..... B24B 12/32

See application file for complete search history.

(56) References Cited

U.S. PATENT DOCUMENTS

| | | | | |
|---|---|---|---|---|
| 5,679,920 | A * | 10/1997 | Hallis | F42B 12/74 102/398 |
| 6,799,518 | B1 * | 10/2004 | Williams | F42B 12/74 102/513 |
| 6,846,372 | B1 * | 1/2005 | Guirguis | C06B 45/00 102/473 |
| 2009/0211484 | A1 * | 8/2009 | Truitt | F42B 12/32 102/497 |

OTHER PUBLICATIONS

Ames, "A standardized evaluation technique for reactive warhead fragments", 23rd International Symposium on Ballistics Tarragona, Spain, Apr. 16-20, 2007.

Battezzati, L., et al., "Solid state reactions in Al/Ni alternate foils induced by cold rolling and annealing", Acta mater., (1999) vol. 47, No. 6, pp. 1901-1914.

(Continued)

*Primary Examiner* — George Wyszomierski
*Assistant Examiner* — Ngoclan T Mai
(74) *Attorney, Agent, or Firm* — Johns Hopkins Technology Ventures

(57) ABSTRACT

An embodiment in accordance with the present invention provides a method for creating and consolidating fragments and a useable structure formed from said consolidated fragments. The method includes swaging a metal powder into a first consolidated structure. The consolidated structure is ground to form particles and the particles are sifted to select those with a predetermined diameter. The particles having the predetermined diameter can then be swaged into a second consolidated structure. The resultant second consolidated structure is therefore configured to fragment controllably. The second consolidated structure can also be formed from reactive metal laminates such that the structure also has chemical energy.

15 Claims, 5 Drawing Sheets

(56) References Cited

OTHER PUBLICATIONS

Morsi, K., et al., "Effect of nickel particle size on the compaction behavior of rotator mixed and mechanically alloyed nickel and aluminum powders", Materials Science and Engineering, (2006) vol. 426, pp. 283-288.

Sieber, H., et al., "Structural evolution and phase formation in cold-rolled aluminum—nickel multilayers", Acta mater., (2001) vol. 49, pp. 1139-1151.

* cited by examiner

STRUCTURAL COMPONENT THAT WILL FRAGMENT INTO PARTICLES OF SELECTED GEOMETRY AND REACTIVITY

CROSS REFERENCE TO RELATED APPLICATIONS

This application claims the benefit of U.S. Provisional Patent Application No. 61/649,515, filed on May 21, 2012, which is incorporated, herein, by reference, in its entirety. The present application also incorporates U.S. Provisional Patent Application No. 61/487,772 filed on May 19, 2011, in its entirety.

GOVERNMENT SPONSORSHIP

This invention was made with government support under Number N000014-07-1-0740 awarded by the Office of Naval Research. The Government has certain rights in this invention.

FIELD OF THE INVENTION

The present invention relates generally to structural design. More particularly, the present invention relates to a design for a fragmentable structural component.

BACKGROUND OF THE INVENTION

The size and weight of a system designed to defeat military equipment, improvised explosive devices (IEDs) or an incoming projectile are constrained by the need for both fragments to destroy the target and a structure to hold them. Loose fragments do not provide the mechanical support required for a stable device. A solid metal structure, such as a missile casing, is too sturdy to breakup easily or reliably. Patterning a solid structure facilitates breakup but reduces mechanical strength. In contrast, a solid material which provides mechanical strength yet fragments controllably offers a significant weight savings over existing systems.

Bonding fragments together into a larger structure that provides the necessary mechanical integrity, yet will breakup controllably on detonation, can achieve this weight saving. This enables the selection of fragments of a known mass, geometry and desired dispersion pattern, yet with the same strength as a solid structure. The challenge is in selecting a sufficiently strong bonding method that will breakup as desired. A variety of bonding methods exist, each with different strengths and weaknesses. Polymeric glue is simple, but lacks sufficient stiffness, strength or density comparable to metals. Fragments could also be isostatically pressed, either hot or cold, to remove voids, but large fragments will not bond strongly with such minimal material deformation.

Fragment effectiveness can be increased by replacing inert material with one that will release chemical energy on impact. The benefits of reactive fragments have previously been demonstrated. One effective fragment technology is known as reactive laminates, specifically intermetallic formation reactions such as the Al/Ni alloying reaction. This material adds chemical energy to the projectile's kinetic energy, generating a high temperature to drive eta fuel combustion. The Al/Ni reactive laminate is also a metal-metal composite, capable of providing the mechanical support needed in a reactive structure.

It would therefore be advantageous to provide a method for the fabrication of mm-scale reactive fragments and the subsequent consolidation of these particles into a larger, mechanically robust structure.

SUMMARY OF THE INVENTION

The foregoing needs are met, to a great extent, by the present invention, wherein in one aspect a method for forming a structural component that will fragment into particles of selected geometry and reactivity includes swaging a metal powder into a consolidated structure. The method also includes grinding the consolidated structure into particles. The particles are sifted to select particles for use having a predetermined diameter. The particles having the predetermined diameter into the structural component that will fragment into particles of selected geometry and reactivity.

In accordance with another aspect of the present invention, the metal powder is configured to impart the particles with the selected reactivity. The consolidated structure takes the form of a tube, and the structural component takes the form of a tube. Swaging the structural component further comprises reducing a cross-sectional area of the structural component by 50% or more. The predetermined diameter is between approximately 1 mm to approximately 2.3 mm.

In accordance with another aspect of the present invention, the method further includes using a rotating die for swaging the metal powder and for swaging the particles having the predetermined diameter. The rotating die can take the form of a progression of dies. The metal powder takes the form of at least one of Al, Ni, Mg, and W. Further, the method includes packing the metal powder into a tube before swaging and removing the tube after swaging. The tube takes the form of a steel tube. The metal powder can also take the form, at least in part, of a metal fuel, such as Ti, Zr, or AlMg.

In accordance with another aspect of the present invention, a consolidated includes an elongate tube having an outer wall and a first end and a second end, said outer wall defining an elongate lumen extending from the first end to the second end. The outer wall is formed from particles having a predetermined diameter. The particles are swaged to form the elongated tube. The particles are formed by swaging a metal powder into a consolidated tube and grinding said consolidated tube into said particles.

In accordance with yet another aspect of the present invention, the metal powder is configured to impart the particles with the selected reactivity. Swaging the elongated tube further includes reducing a cross-sectional area of a wall of the structural component by half. The predetermined diameter is between approximately 1 mm to approximately 2.3 mm.

BRIEF DESCRIPTION OF THE DRAWINGS

The accompanying drawings provide visual representations which will be used to more fully describe the representative embodiments disclosed herein and can be used by those skilled in the art to better understand them and their inherent advantages. In these drawings, like reference numerals identify corresponding elements and.

DETAILED DESCRIPTION

Figure 1A:
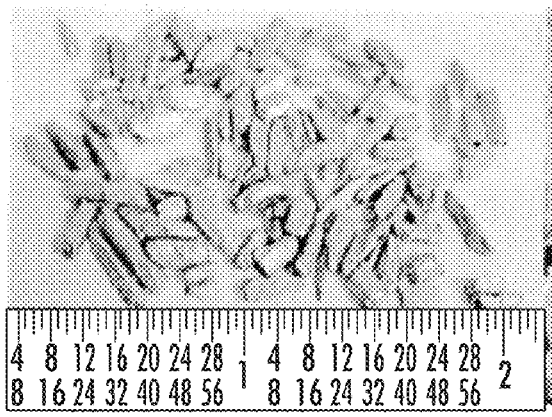
FIG. 1A illustrates a perspective view of fragments after a first swaging according to an embodiment of the invention.

The presently disclosed subject matter now will be described more fully hereinafter with reference to the accompanying Drawings, in which some, but not all embodiments of the inventions are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

An embodiment in accordance with the present invention provides a method for creating and consolidating fragments and a useable structure formed from said consolidated fragments. The method includes swaging a metal powder into a first consolidated structure. The consolidated structure is ground to form particles and the particles are sifted to select those with a predetermined diameter. The particles having the predetermined diameter can then be swaged into a second consolidated structure. The resultant second consolidated structure is therefore configured to fragment controllably. The second consolidated structure can also be formed from reactive metal laminates such that the structure also has chemical energy.

Swaging can be used to form both a first and second consolidated structure. Preferably, the first consolidated structure takes the form of a rod or a tube and the second consolidated structure will take the form of a tube having elongate central lumen extending therethrough. Swaging is a consolidation method, where a rotary die rapidly opens and closes to uniformly reduce the diameter of a rod. A progression of dies enables the reduction from large diameters to small diameters. Swaging also generates significant shear deformation, exposing fresh metal surfaces to enhance bonding between separate fragments. Additionally, swaging is a room temperature and atmospheric pressure process, unlike cold isostatic pressing (CIPing) or hot isostatic pressing (HIPing). As such, swaging is one candidate method for consolidating fragments into a larger structure. While the use of rotating dies of different diameters is disclosed herein, any other swaging procedure or similar manner of consolidating the particles and enhancing bonds between separate fragments known to one of skill in the art could also be used.

An exemplary embodiment is described herein. However, this embodiment is in no way considered to be limiting, and any other method known to one of skill in the art could be used to obtain a similar structure or a structure seen as equivalent by one of skill in the art. By way of example, consolidated structures of reactive fragments can require two distinct swaging operations. The first creates mm-scale fragments, while the second consolidates fragments into a single cylinder. Preferably, 63 μm diameter (−250 mesh) powder of Al/7.9 wt. % Mg, 45 μm (−325 mesh) Ni powder, and 45 μm (−325 mesh) W powder are used in the first swaging operation in order to form particles having a predetermined diameter. The Al—Mg, and Ni powders were measured out in a 1:1 stoichiometric mixture in order to produce a 50/50 atomic ratio of Ni and Al—Mg. 45.2 wt. % W powder can also be added to this mixture to raise the compacted density from 5.2 g/cc to 7.8 g/cc, the density of steel. It should be noted that any mix of metals known to one of skill in the art can be used to form the reactive fragments.

To first form a consolidated structure, 25 g increments of the powder mixture is poured into a 0.625" OD, 0.555" ID 304 stainless steel tube. The bottom of each tube is plugged with a length of Al 6061 to prevent powder spillage. The powder is uniaxially pressed in an Instron 5582 to 8000 psi to compact the powder. This process is repeated until the tube is almost full. A 1" long Al 6061 plug is then inserted atop the powders, and the edges are crimped to seal the tube. A packed tube made using the above described process can be swaged through a progression of dies to a final OD of 0.323". The packed tube is preferably swaged initially in a Fenn 3Fswager, but several steps required the greater force of a Fenn 5F swager. Alternatively, any swager know to one of skill in the art can be used to swage the powder into the first consolidated tube.

Figure 1B:
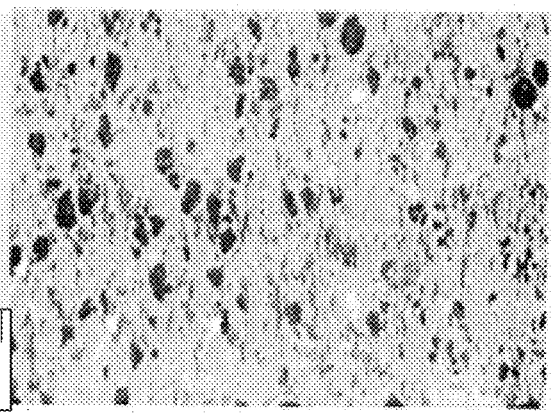
FIG. 1B illustrates an enlarged view of one of the fragments illustrated in FIG. 1A, according to an embodiment of the invention.

Preferably, the first consolidated structure is then cut into sections to remove the steel jacket, resulting in 4" long by 0.25" diameter rods of consolidated AlMg/Ni/W. However, the first consolidated structure can be removed from the steel jacket in any manner known to one of skill in the art. The first consolidated tube is then broken and ground in a low-tech commercial system for 20 seconds. The resulting particles are sifted through commercial sieves with 2.3 mm and 1 mm spacings. Particles greater than 2.3 mm can be ground again to reduce their size. Particles smaller than 1 mm are removed. Material between 1 mm and 2.3 mm in diameter was selected for consolidation, and can be seen in FIGS. 1A and 1B. While the range of 1 mm to 2.3 mm is given for the diameter of the particles any other suitable diameter range could be used. FIG. 1A illustrates fragments after the first swaging operation and subsequent grinding, and FIG. 1B illustrates a close up of the microstructure of one of the fragments, illustrating the AlMg/Ni/W composite structure.

Figure 2:
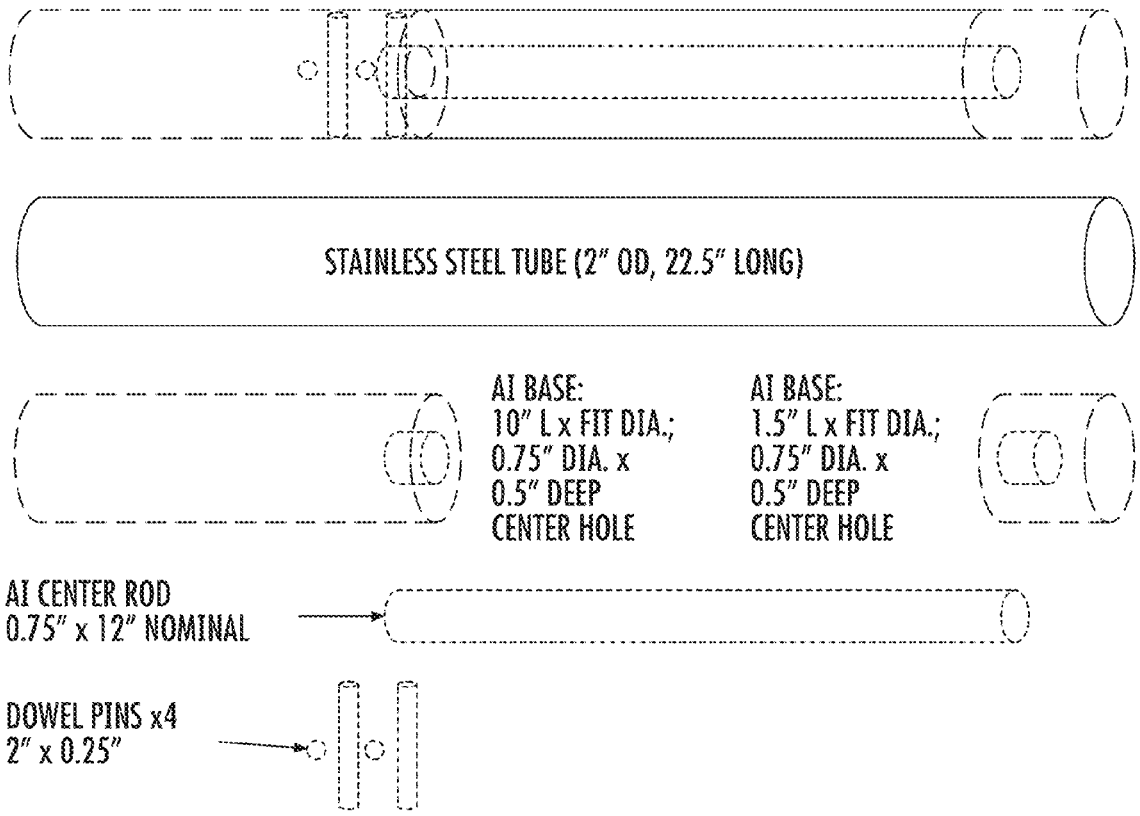
FIG. 2 illustrates a schematic diagram of a set of tubes used in a swaging operation according to an embodiment of the invention.

The second swaging operation includes packing the sifted reactive particles around an aluminum rod nested inside a stainless steel tube, which can be machined away once swaging is complete. By way of example, one end of a 2" OD, 1.87" ID 304 stainless steel tube is plugged with a rod of Al6061, pinned in place. A 0.75" diameter Al6061 rod is pinned in the center of the end of the larger Al rod, inside the stainless steel tube. A schematic of the tubes used for the second swaging operation can be seen in FIG. 2. The center rod reduces the volume of material required to pack the tube, and reduces the volume that must be compressed before the cylinder is fully dense. Additionally, the aluminum is easier to machine than the reactive fragments, facilitating the fabrication of the desired cylindrical geometry. While exemplary dimensions and configurations are given for the tubes to complete the second swaging operation, any swaging device having suitable dimensions for the end product can be used to complete the second swaging operation.

In one example of the second swaging operation, 50 g of the 1 mm to 2.3 mm reactive particles are poured into the tube, around the smaller Al rod. A hollow steel cylinder with a 0.76" diameter center hole is uniaxially pressed atop the particles to 4000 psi to compact the particles. Once the tube was mostly filled, the end is capped with a 1.5" long Al6061 plug, and the stainless steel tube sealed by crimping the edges. However, the tube can be filled in any manner known to one of skill in the art. The tube is then swaged in a Fenn 5F swager. A progression of dies enable the reduction of the material from 2" OD to 1,045" OD over 4 steps, to remove voids and reduce the cross-sectional area by one half to ensure bonding between particles. Any suitable swaging machine can be used in order to reduce the cross-sectional area by a desired amount. It should also be noted that the cross section area of the material can be any area known to one of skill in the art and suitable for the final product.

Figure 3:
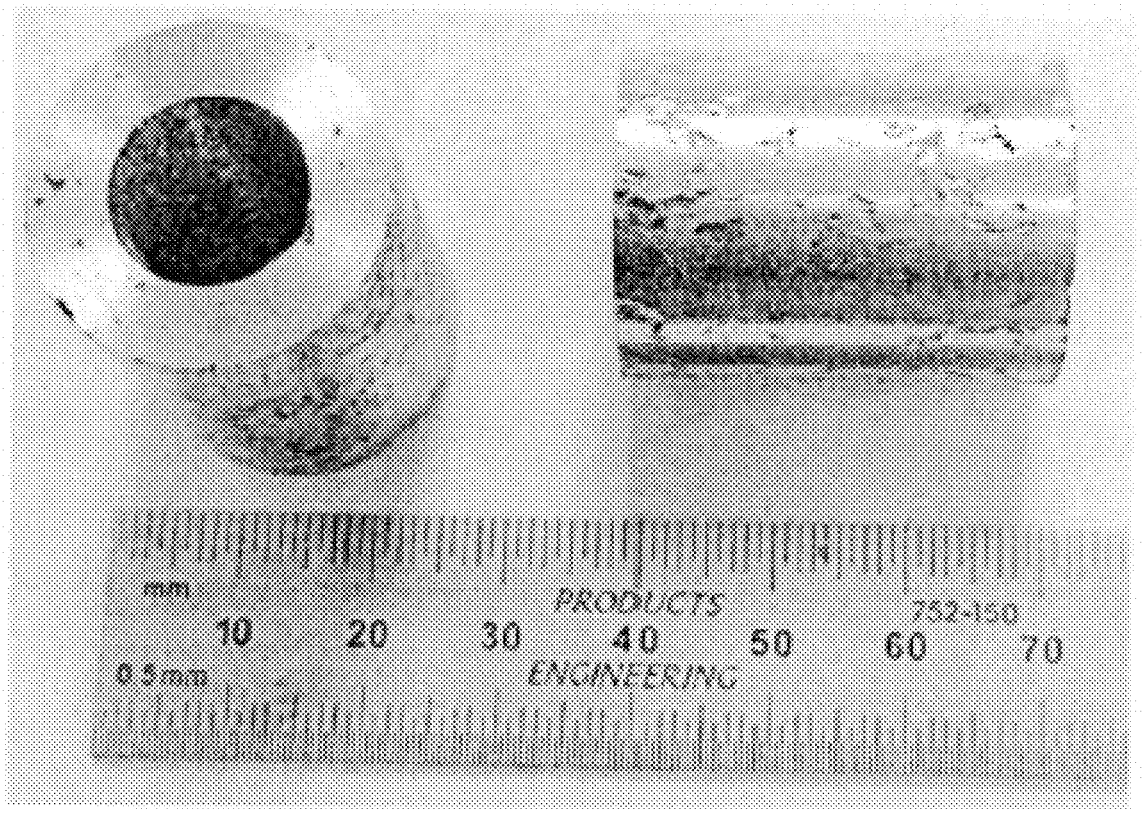
FIG. 3 illustrates a top down view of machined cylinders made from a consolidated material after a second swaging operation, according to an embodiment of the invention.

The swaged rod is then machined using conventional tools and techniques. Oil cooling is utilized due to the presence of Mg, which is highly reactive with water. However, the cooling material can be varied based on the metals chosen to form the powder to for the reactive particles. The stainless steel jacket was milled off using a lathe, and the center Al rod drilled out. The result is a hollow cylinder of small reactive fragments that have been consolidated into a single structure. The final dimensions of the machined cylinders were 1.22" long, with a 0.937" OD and 0.507" ID, as illustrated in FIG. 3. Of course the end product can have any dimensions necessary and known to one of skill in the art.

Testing of the exemplary consolidated structure was also done. This testing is detailed herein to further describe the properties of the consolidated structure. This information is included by way of example and is not intended to limit the claimed invention. The density of the swaged material can be calculated directly from the mass and dimensions of the machined cylinder. The density of the swaged powder was measured by a Micromeritrics AccuPyc II 1340 He-gas pycnometer, which measures the open pore density of small samples. Cross-sections of the final swaged rod were polished and optically imaged to determine composition distribution and structure. The thermal behavior of the material was characterized by differential scanning calorimetry (DSC) using a Perkin-Elmer Pyris 1 DSC. Samples of the initial swaged fragments, as well as portions of the consolidated tube, were heated from 50° C. to 725° C. and the heat output recorded to quantify the energy released by the reactive material, and determines how the energy release changes with processing.

Figure 4:
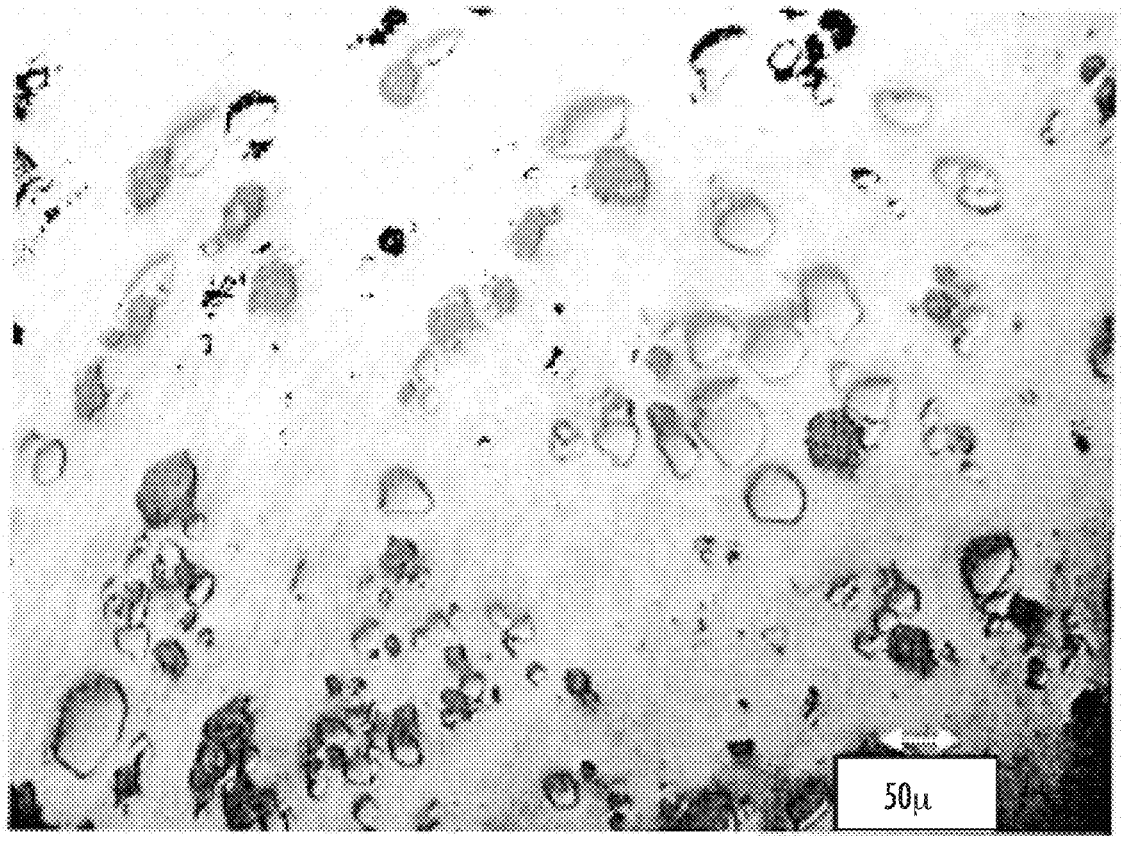
FIG. 4 illustrates an enlarged view of a polished cross-section of a swaged cylinder after a second swaging operation.

Mesh sifting retains particles based on the two smallest dimensions. This minimum or maximum diameter preferentially selects fragments with an ellipsoid geometry. the case of the materials utilized in the second swaging operation, many of the fragments were significantly longer than they were wide, as seen above in FIGS. 1A and 1B. Cross-sections of the reactive rod after the second swaging operation were polished with standard metallurgical SiC paper and diamond suspensions down to a 0.25~–tm finish. An optical photo of this polished sample is illustrated in FIG. 4. The large W particles are distributed in a matrix of the AlMg/Ni powders. The lighter AlMg particles are distributed evenly with the darker Ni particles, indicating the softer powders deformed preferentially to the stiffer W particles. Also of note, is the clear boundary between two of the initially swaged fragments, as seen in the differing textures of the AlMg/Ni matrix illustrated in FIG. 4. More particularly, FIG. 4 illustrates a polished cross-section of swaged cylinder after the second swaging operation.

Figure 5:
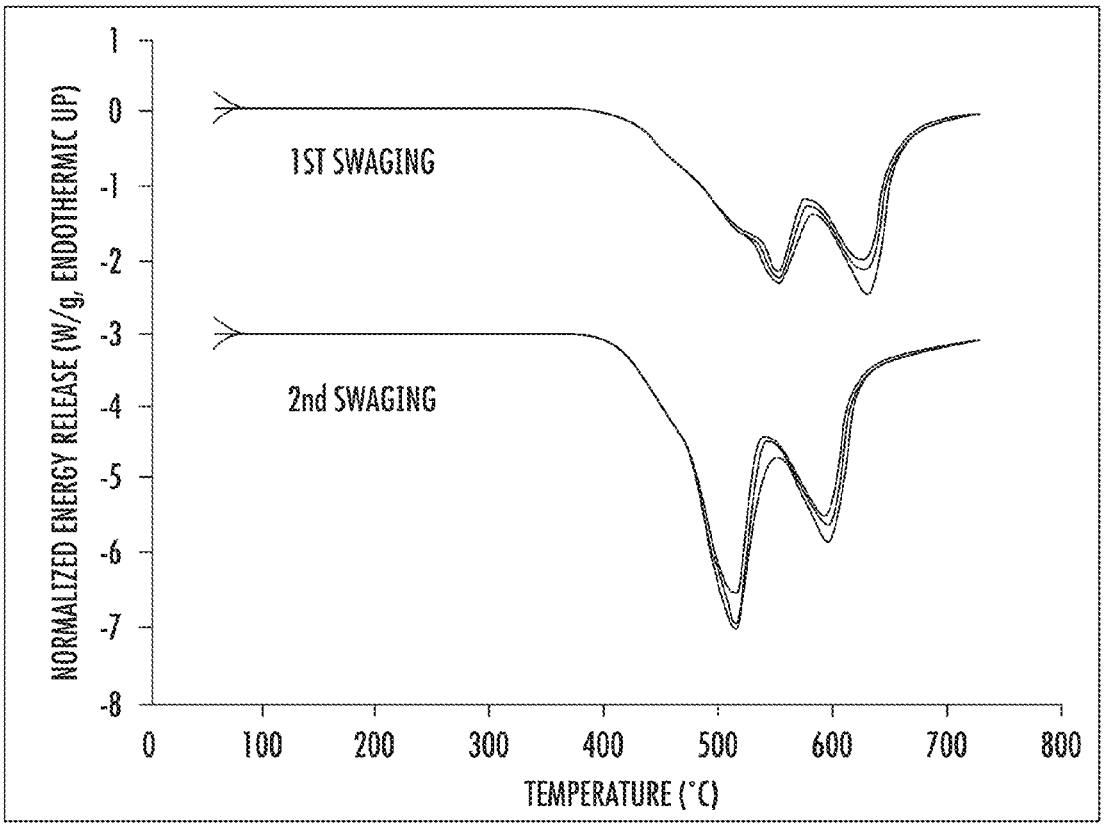
FIG. 5 illustrates a differential scanning calorimetry (DSC) analysis of a reactive fragment after a first and second swaging operation according to an embodiment of the invention.

As the initial compact was swaged, each of the reactive fragments adopted the preferential texturing direction of the swaged material along the swaging direction. The dark pores in the material are likely W pullouts, as the W particles are not strongly bonded to the matrix as the matrix underwent most if not all of the deformation during swaging. The density of the initial swaged fragments averaged 7.88 g/cc, which is close to the target density of 7.8 g/cc. However, the measured densities of sections cut from the initial swaged rod ranged from 7.7 to 8.1 g/cc, along a length of several inches. This indicates that while there is some variation in the material density as swaged (likely due to local variations in the amount of tungsten), the overall density is correct. As such, the density of several grams of blended particles was measured to be 7.67 g/cc, DSC was performed on materials after both the first and second swaging operations. A comparison of the thermal performance of three samples after each of these steps can be seen in FIG. 5. More particularly, FIG. 5 illustrates, a DSC of reactive fragment material after first and second swaging operations. The graph of FIG. 5 reports traces from 3 samples from each of the materials.

After the second swaging operation, the material exhibits significantly lower peak temperatures, as seen in Table 1, below, indicating the intermetallic formation reaction is occurring more rapidly. This is likely due to the microstructure of the material refining during deformation. The material also exhibits a greater measurable heat release after the second swaging, releasing 25% more energy per unit mass in DSC than the material after the first swaging. This correlates with the lower peak temperatures.

TABLE 1

Energy and Peak Temperature of Swaged Reactive Materials

| | Energy | | $1^{st}$ Peak | $2^{nd}$ Peak |
|---|---|---|---|---|
| Material | J/g | St. Dev. | ° C. | ° C. |
| $1^{st}$ Swaging | −487 | 17.8 | 552 | 626 |
| $2^{nd}$ Swaging | −612 | 10.4 | 514 | 596 |

While this system has been described for use in defeating military equipment, IEDs, and incoming projectiles, it need not be limited to these applications and could be used for different applications known to one of skill in the art. In addition, one could easily vary in initial fragment size and microstructure; utilize reactive laminate structures in addition to or instead of elemental powders; utilize different chemistries, such as a boride formation reaction; add a metallic fuel (e.g. Ti, Zr, AlMg); or and/or a component which melts or vaporizes on impact.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for forming a structural component that will fragment into particles of selected geometry and reactivity comprising:

swaging a metal powder into a consolidated structure;

grinding the consolidated structure into particles;

sifting the particles to select particles for use having a predetermined diameter;

swaging the particles having the predetermined diameter into the structural component that will fragment into particles of selected geometry and reactivity.

2. The method claim 1 wherein the metal powder is configured to impart the particles with the selected reactivity.

3. The method of claim 1 wherein the consolidated structure takes the form of a rod.

4. The method of claim 1 wherein the structural component takes the form of a tube.

5. The method of claim 1 wherein swaging the structural component further comprises reducing a cross-sectional area of the structural component by half.

6. The method of claim 1 wherein the predetermined diameter is between approximately 1 mm to approximately 2.3 mm.

7. The method of claim 1 further comprising using a rotating die for swaging the metal powder.

8. The method of claim 7 wherein the rotating die further comprises a progression of dies.

9. The method of claim 1 further comprising using a rotating die for swaging the particles having the predetermined diameter.

10. The method of claim 9 wherein the rotating die further comprises a progression of dies.

11. The method of claim 1 wherein the metal powder comprises at least one of Al, Ni, Mg, and W.

12. The method of claim 1 further comprising packing the metal powder into a tube before swaging.

13. The method of claim 12 further comprising removing the tube after swaging.

14. The method of claim 12 wherein the tube comprises a steel tube.

15. The method of claim 1 wherein the metal powder comprises at least in part a metal fuel taking the form of Ti, Zr, or AlMg.

* * * * *